US008424322B2

(12) United States Patent
Seki

(10) Patent No.: US 8,424,322 B2
(45) Date of Patent: Apr. 23, 2013

(54) AIR CONDITIONER WITH ESTIMATION OF ENERGY EFFICIENCY, ENERGY CHARGE EFFICIENCY AND CO2 EMISSION EFFICIENCY

(75) Inventor: Tatsuo Seki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 944 days.

(21) Appl. No.: 12/507,195

(22) Filed: Jul. 22, 2009

(65) Prior Publication Data

US 2010/0064708 A1 Mar. 18, 2010

(30) Foreign Application Priority Data

Sep. 17, 2008 (JP) ..... 2008-237460

(51) Int. Cl.
*F25B 49/00* (2006.01)

(52) U.S. Cl.
USPC ..... 62/127; 62/125; 62/126; 62/157; 62/231; 340/870.16; 340/870.17

(58) Field of Classification Search ..... 62/125, 62/126, 127, 157, 231; 340/870.16, 870.17
See application file for complete search history.

(56) References Cited

U.S. PATENT DOCUMENTS

| | | | | |
|---|---|---|---|---|
| 6,145,328 | A * | 11/2000 | Choi | 62/127 |
| 2007/0203860 | A1 | 8/2007 | Golden et al. | |
| 2008/0179410 | A1 | 7/2008 | Yoon et al. | |

FOREIGN PATENT DOCUMENTS

| | | | |
|---|---|---|---|
| EP | 1 944 558 | | 7/2008 |
| EP | 1 950 504 | | 7/2008 |
| JP | 01-316251 | | 12/1989 |
| JP | 06-288595 | | 10/1994 |
| JP | 6-288595 | A | 10/1994 |
| JP | 3060195 | U | 7/1999 |
| JP | 11-295358 | | 10/1999 |
| JP | 2000-152500 | | 5/2000 |

(Continued)

OTHER PUBLICATIONS

Notification of Rejection dated Sep. 14, 2010, issued in the corresponding Japanese Application No. 2008-237460, and an English Translation thereof.

(Continued)

*Primary Examiner* — Cheryl J Tyler
*Assistant Examiner* — Jonathan Bradford
(74) *Attorney, Agent, or Firm* — Posz Law Group, PLC

(57) ABSTRACT

An air conditioner that can present information on a predicted value of stored energy usage per unit time, a predicted value of the electricity charge per unit time, and a predicted value of the amount of CO2 emission per unit time, at the start of operation. The air conditioner includes a predicted electricity efficiency speculating unit that speculates on electricity efficiency, which is stored energy usage per unit time predicted from a set parameter set by the user at the present time, based on a stored value of the recent stored energy usage storing unit, a calculated result of the actual usage electricity efficiency calculating unit, and a compared result of the setting comparing unit, a predicted electricity efficiency calculating unit that calculates an electricity charge per unit time or a predicted amount of CO2 emission efficiency calculating unit that calculates an amount of CO2 emission per unit time, and a displaying unit that displays the calculated information stored energy usage at the start of air conditioner operation.

5 Claims, 9 Drawing Sheets

FOREIGN PATENT DOCUMENTS

| | | | |
|---|---|---|---|
| JP | 2001-153440 | | 6/2001 |
| JP | 2002-040065 | | 2/2002 |
| JP | 2002-118960 | | 4/2002 |
| JP | 2002-118960 | A | 4/2002 |
| JP | 2002-297078 | | 10/2002 |
| JP | 2006-162424 | | 6/2006 |
| JP | 2006-162424 | A | 6/2006 |
| JP | 2006-309325 | | 11/2006 |
| JP | 2008-003843 | | 1/2008 |

OTHER PUBLICATIONS

Partial European Search Report dated Nov. 25, 2010, issued in the corresponding European Patent Application No. 09166733.7-2301.
Extended European Search Report dated Mar. 28, 2011 issued in corresponding EP patent application No. 09166733.7-2301.
Office Action mailed Aug. 19, 2011 in corresponding CN application No. 200910160210.6 (and partial English translation).

* cited by examiner

Fig. 4

| TEMPERATURE DIFFERENCES [℃] | CHANGE RATIOS [%] |
|---|---|
| 0 | CHANGE AMOUNT 0 |
| 1 | CHANGE AMOUNT 1 |
| 2 | CHANGE AMOUNT 2 |
| 3 | CHANGE AMOUNT 3 |
| 4 | CHANGE AMOUNT 4 |
| 5 | CHANGE AMOUNT 5 |
| 6 | CHANGE AMOUNT 6 |
| 7 | CHANGE AMOUNT 7 |
| 8 | CHANGE AMOUNT 8 |
| 9 | CHANGE AMOUNT 9 |
| 10 | CHANGE AMOUNT 10 |

AIR CONDITIONER WITH ESTIMATION OF ENERGY EFFICIENCY, ENERGY CHARGE EFFICIENCY AND CO2 EMISSION EFFICIENCY

BACKGROUND OF THE INVENTION

1. Field of the Invention

The present invention relates to an air conditioner. In detail, the present invention relates to an information displaying apparatus of the air conditioner, and particularly it relates to displaying of information concerning energy consumption by the air conditioner.

2. Description of the Related Art

Most of the conventional air conditioners do not provide any particular information, such as decision data, to a user for making decision of a setting of the air conditioner. Such setting merely is based on the user's perception and intention at a start of the operation.

For example, patent document 1 discusses a conventional air conditioner that provides various sensors and inputting units for attempting to solve the above problem, that estimates a PMV value, the comfort index, and that estimates a running cost by estimating an air conditioning load. These estimations are displayed to the user as the decision data in making a decision on the setting.

Also, besides the air conditioners, there is proposed an energy management system that acquires an amount of electricity in use, as described below.

For example, patent document 2 discusses an energy management system that predicts a monthly amount of the electricity in use, at end of a current month, on a current day, based on the accumulated data.

As another example, patent document 3 discusses an energy management system in which the management center acquires the amount of electricity in use by each dwelling, calculates the electricity charge of this month predicted up to today for each dwelling, and displays the information on a personal computer of each dwelling via the Internet. However, this document does not specifically mention the prediction method.

[Patent Document 1] Japanese Published Patent Application No. 6-288595 (pages 2 to 4)

[Patent Document 2] Japanese Published Patent Application No. 2002-118960 (pages 5 to 7)

[Patent Document 3] Japanese Published Patent Application No. 2006-162424 (page 5).

SUMMARY OF THE INVENTION

The air conditioner of patent document 1, however, is not without problems. There is a need for a way to provide various kinds and types of sensors and inputting units; as a consequence, the cost of the air conditioner becomes too expensive.

Also, this air conditioner faces a problem in terms of accuracy of the estimations. Since the estimations are made based on detected values of the sensors or information inputted by the user, and do not depend on an actual usage of the air conditioner, the estimations may be wrongly made due to error detection in the sensors or wrong input by the user.

The energy management system of patent document 2, however, is also not without problems. Since this energy management system manages the amount of electricity in use within a facility, not on a device basis; therefore, the information on a device which is about to be used by the user cannot be acquired.

Also, this energy management system faces a problem in terms of accuracy of the predicted results. This is because the accumulated data is not separately managed despite the fact that there are various modes available on the device basis, such as heating, cooling, dehumidifying and ventilation operation modes in the air conditioner.

The energy management system of patent document 3 mentions about outputting the electricity charge predicted up to today for this month; however, it does not specifically mention about the prediction method at all. How this system makes the prediction is unknown in specific terms.

In addition, neither one of the patent documents disclose an automatic display to the user, at the start of the operation of the air conditioner. This being the case, the effectiveness of urging the user to change the setting to an environmentally friendly mode or an energy saver mode is low. (In most cases, the user makes the setting before starting the operation of the air conditioner, and leaves the setting unattended.)

The present invention, in attempt to solve the problems mentioned above, is directed to an air conditioner that displays information including at least one of a predicted result of the stored energy usage per unit time at the start of operation, or a predicted value of the electricity charge per unit time, or a predicted value of the amount of CO2 emission per unit time, and appropriately changes information of the predicted result to be displayed, as a result of a set parameter at the start of operation. The present invention is effective in aiding decision making of the set parameter of the air conditioner when the user wishes to save energy and be aware of the environment. Alternatively, it is effective in urging the user to change the setting to the energy saver mode or the environmentally friendly mode.

Also, the present invention is directed to an air conditioner providing a displaying apparatus that can predict the predicted result presented by the air conditioner, based on the actual usage information of the air conditioner and the set parameter before starting the operation of the air conditioner at the present time.

Further, the present invention is directed to an air conditioner providing a displaying apparatus that automatically displays stored energy usage consumed by the operation at the present time during a period starting from the power ON at the present time and ending at power OFF, or an electricity charge spent in the operation at the present time, or a result of the amount of CO2 emission from the operation at the present time, at power OFF of the air conditioner, so that the user can understand the extent of energy saving effect and the extent of decreased environmental burden, as a result of the setting made by the user at the present time, when the user ceases to use the air conditioner.

Accordingly, an air conditioner of the present invention includes:

a setting apparatus that sets an operation mode which a user requests to the air conditioner or an operation condition of the air conditioner for the operation mode;

a control apparatus with a built-in microcomputer having an inputting unit that inputs information from the setting apparatus, a memory unit that stores various control setting values and programs, a CPU that performs a calculation process and a determination process, and an outputting unit that outputs a calculated result and a determined result from the CPU; and a displaying unit that displays the outputs from the outputting unit;

wherein the control apparatus comprises:

a recent stored energy usage storing unit that stores electricity consumed by the air conditioner, as stored energy usage, for each operation mode;

a recent accumulated operation time storing unit that integrates and stores an operation time of the air conditioner, as an accumulated operation time, for each operation mode;

an actual usage electricity efficiency calculating unit that calculates an electricity efficiency, which is an stored energy usage per unit time for the actual usage, based on a stored value of the recent stored energy usage storing unit and a stored value of the recent accumulated operation time storing unit;

a recent average setting storing unit that stores a set parameter set with the setting apparatus by the user, as a time weighted averaged data, for each operation mode;

a setting comparing unit that compares a stored content of the recent average setting storing unit with a set parameter set by the user at a present time at a start of operation;

a predicted electricity efficiency speculating unit that speculates the electricity efficiency predicted as a result of the set parameter set at the present time by the user, based on a calculated result of the actual electricity efficiency calculating unit and a compared result of the setting comparing unit; and at least one of an electricity unit price storing unit that stores an electricity unit price on the memory unit or a CO2 emission coefficient storing unit that stores a CO2 emission coefficient;

at least one of a predicted electricity charge efficiency calculating unit that calculates an electricity charge efficiency, which is an electricity charge per unit time, based on a speculated result of the predicted electricity efficiency speculating unit, and a stored value of the electricity unit price storing unit, or a predicted amount of CO2 emission efficiency calculating unit that calculates an amount of CO2 emission efficiency, which is an amount of CO2 emission per unit time, based on the speculated result of the predicted electricity efficiency speculating unit and the stored value of the CO2 emission coefficient storing unit; and wherein any one of predicted information including the electricity charge efficiency calculated by the predicted electricity charge efficiency calculating unit, or the amount of CO2 emission efficiency calculated by the predicted amount of CO2 emission efficiency calculating unit, or the electricity efficiency speculated by the predicted electricity efficiency speculating unit, is displayed on the displaying apparatus, at the start of the operation of the air conditioner.

The air conditioner of the present invention is configured to predict the stored energy usage per unit time, the electricity charge, and the amount of CO2 emissions, based on a usage period, the stored energy usage, and the set parameter of the air conditioner actually used by the user, and to display this information at the start of operation. In this way, the user can decide on a setting at the start of operation at the present time, while thinking about saving the electricity charge and the extent of depleting the CO2 emission, through the information set by the user him/herself. Therefore, the air conditioner of the present invention produces the effects of energy saving operation awareness by the user and environmentally friendly operation.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 4 illustrates an example of data setting for a change ratio of temperature setting of the air conditioner, in accordance with the first embodiment.

DESCRIPTION OF THE EXEMPLARY EMBODIMENTS

Various exemplary embodiments, features, and aspects of the present invention will now herein be described in detail with reference to the drawings. It is to be noted that the relative arrangement of the components, the numerical expressions, and numerical values set forth in these embodiments are not intended to limit the scope of the present invention unless it is specifically stated otherwise.

First Embodiment

Hereinbelow, the first embodiment of the present invention will be described with reference to FIGS. 1 to 6.

Figure 1:
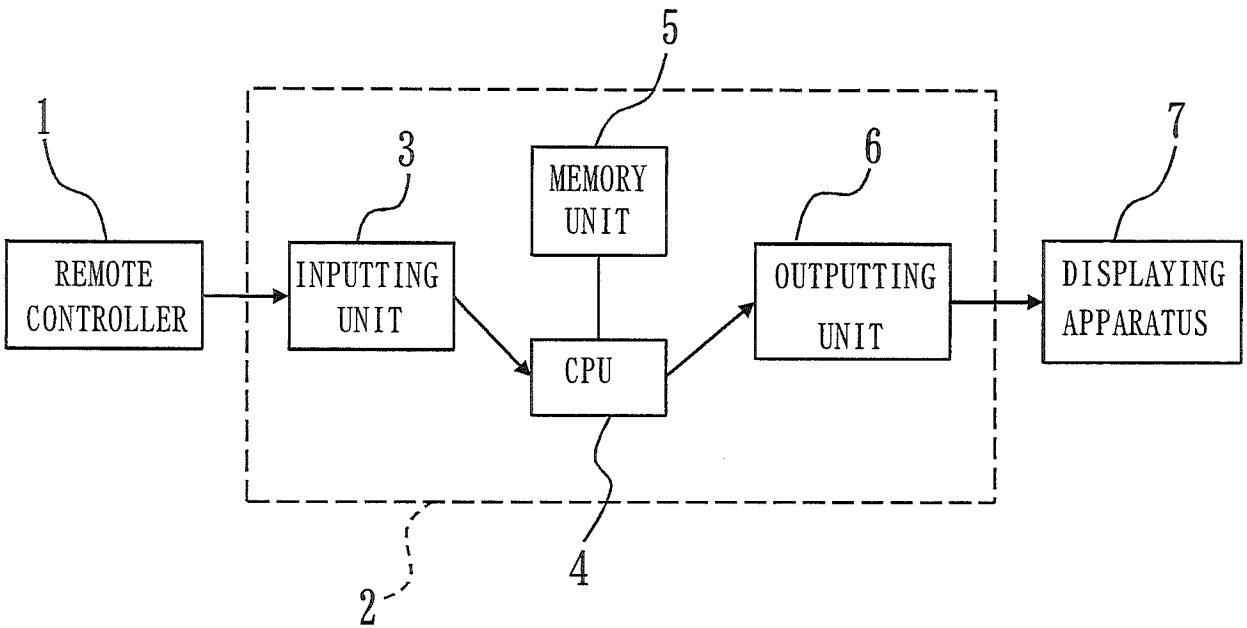
FIG. 1 is a circuit diagram showing a microcomputer of a control apparatus of the air conditioner, in accordance with a first embodiment.
Figure 2:
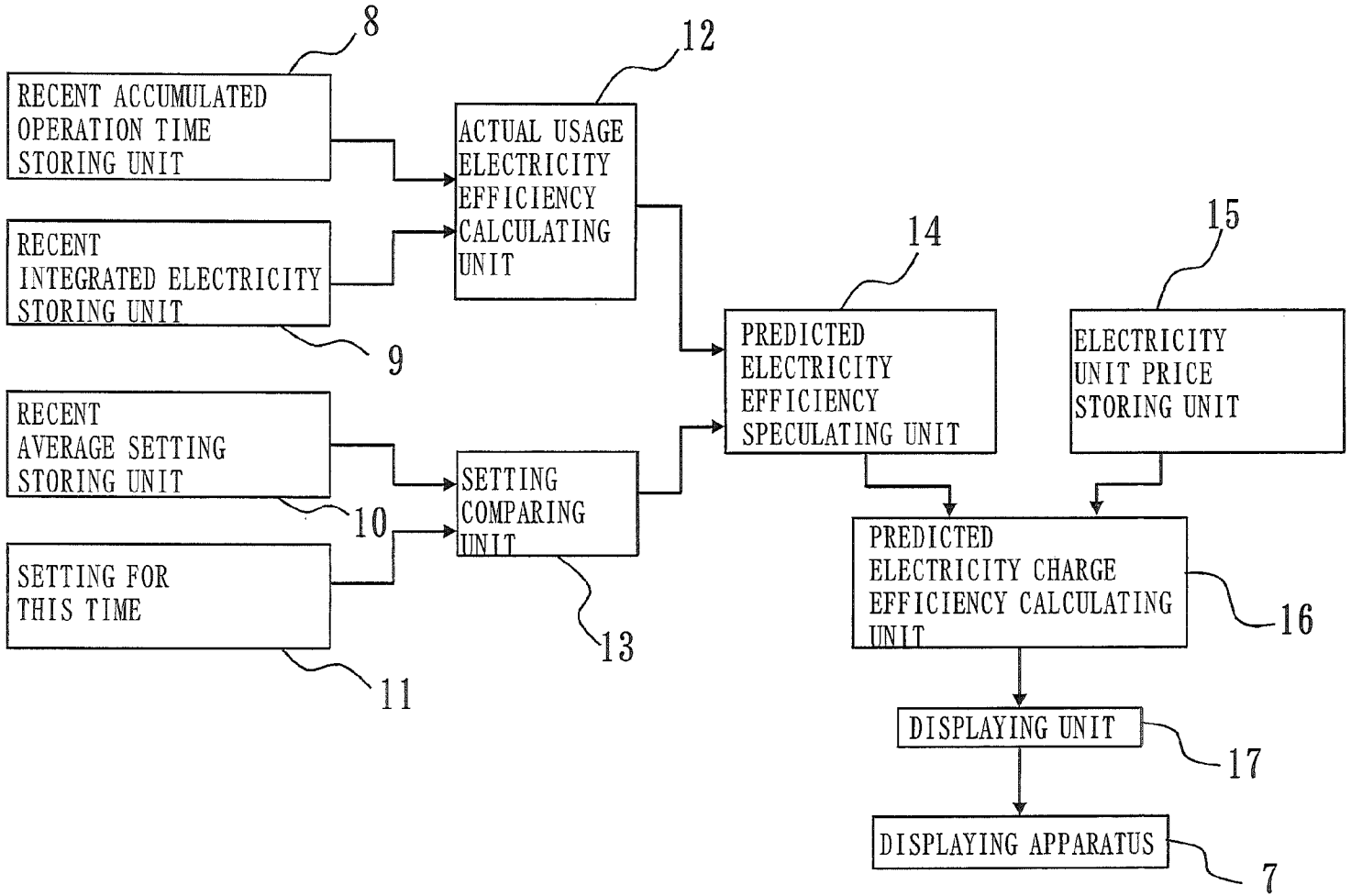
FIG. 2 is a control block chart showing a control of the air conditioner, in accordance with the first embodiment.
Figure 3:
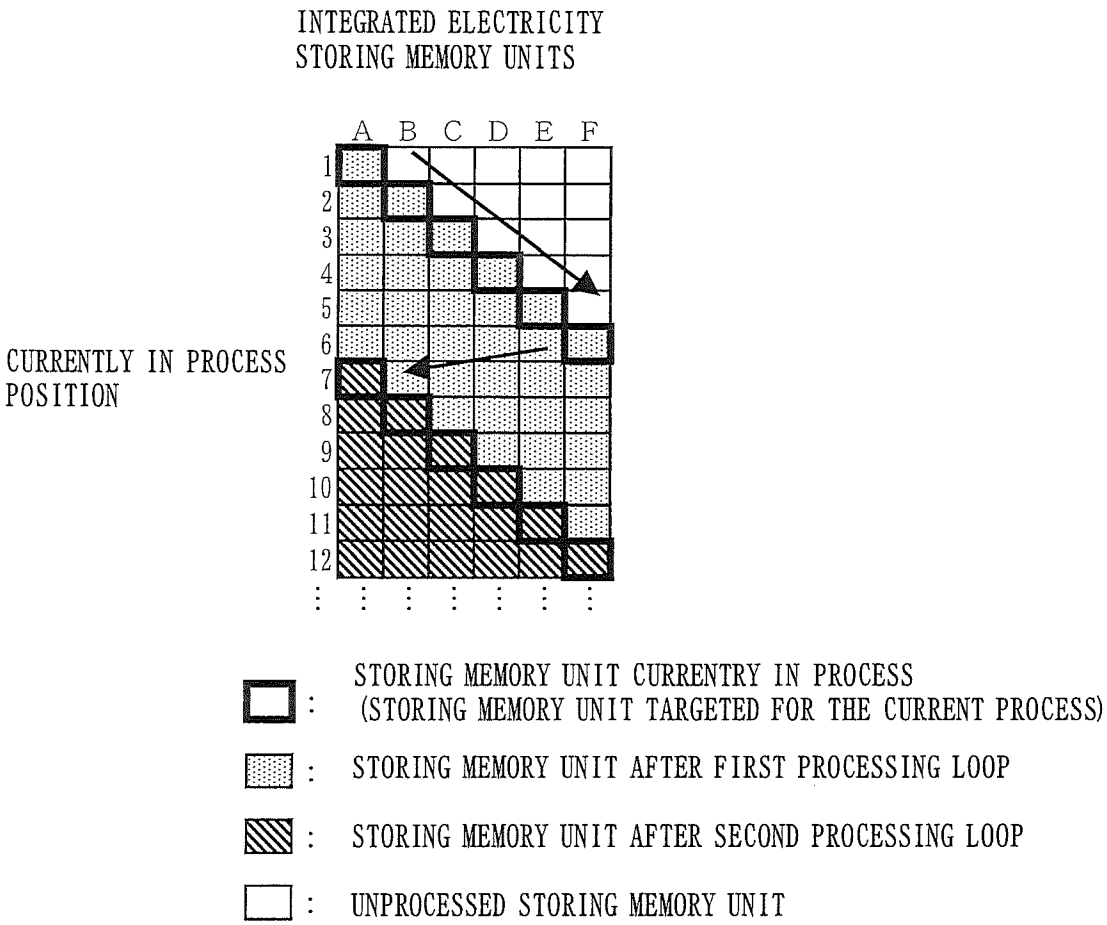
FIG. 3 illustrates a management method of a recent stored energy usage data of the air conditioner, in accordance with the first embodiment.
Figure 5:
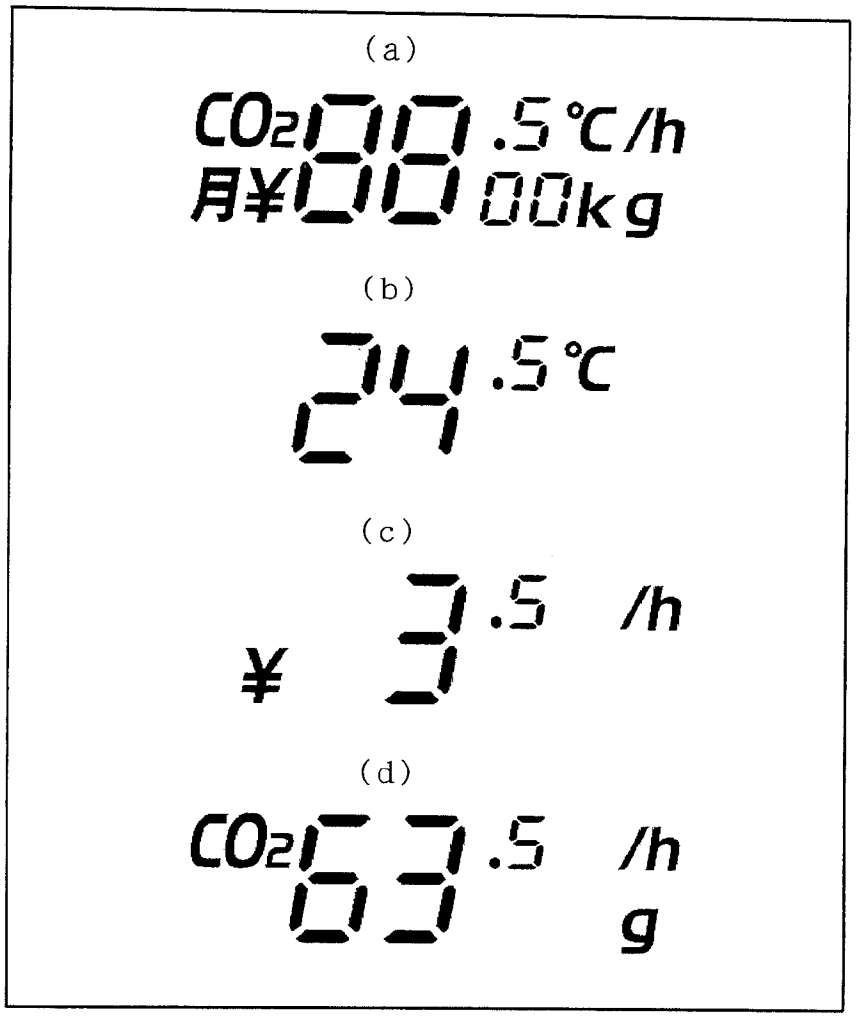
FIG. 5 illustrates examples of display elements of the displaying apparatus of the air conditioner, which include (a) the entire display elements, (b) an example of displaying temperature at a normal display, (c) an example of displaying a predicted electricity charge per unit time, and (d) an example of displaying a predicted amount of CO2 emission per unit time, in accordance with the first embodiment.
Figure 6:
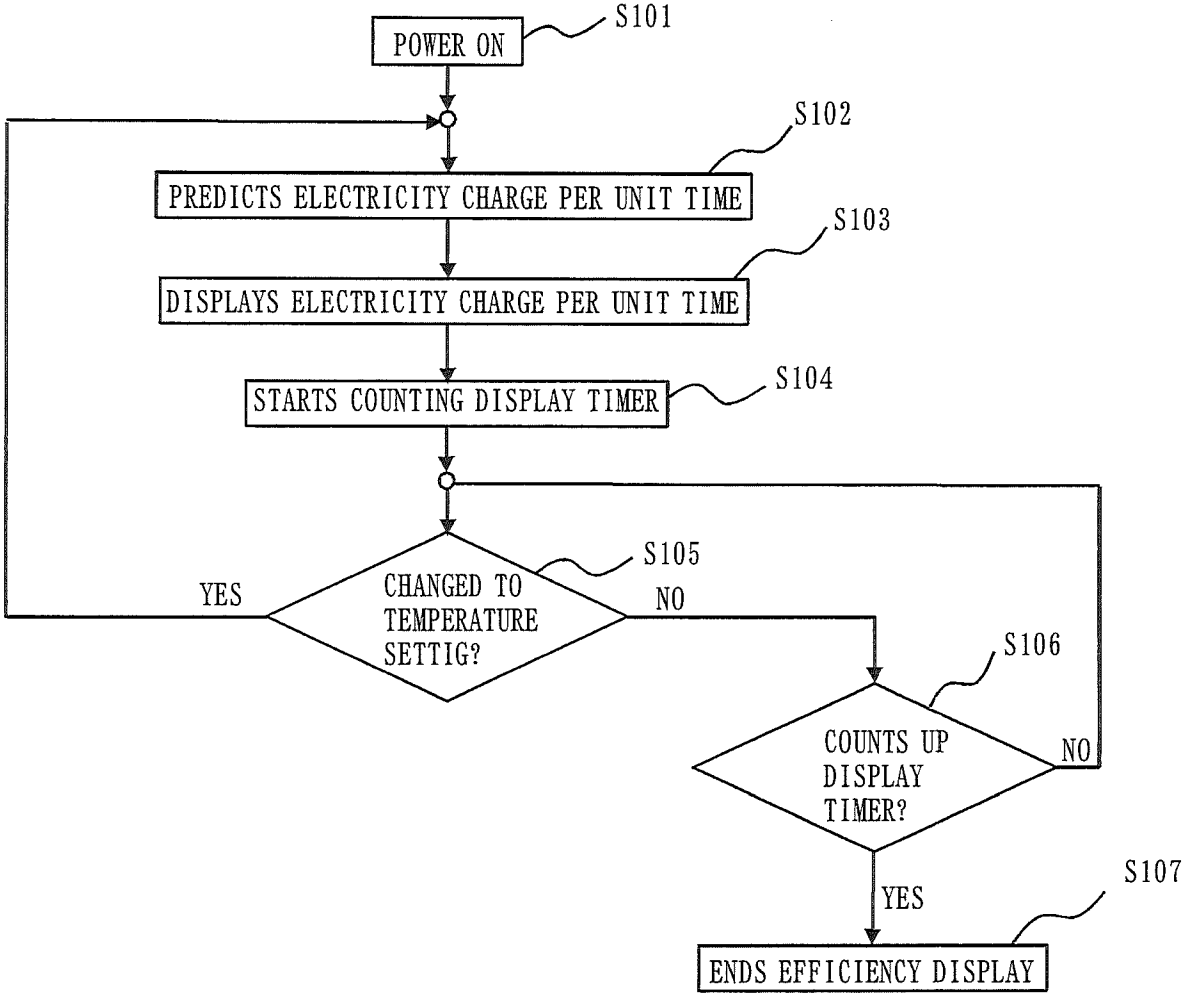
FIG. 6 is a flow chart showing an operation of the air conditioner, in accordance with the first embodiment.

FIGS. 1 to 6 illustrate the first embodiment. FIG. 1 is the circuit diagram showing the microcomputer of the control apparatus of the air conditioner. FIG. 2 is the control block chart showing the control of the air conditioner. FIG. 3 illustrates the management method of the recent stored energy usage data of the air conditioner. FIG. 4 illustrates the example of data setting for the change ratio of the temperature setting of the air conditioner. FIG. 5 illustrates the examples of display elements of the displaying apparatus of the air conditioner, which include (a) the entire display elements, (b) the example of displaying temperature at a normal display, (c) the example of displaying the predicted electricity charge per unit time, and (d) the example of displaying the predicted amount of CO2 emission per unit time, in accordance with the first embodiment. FIG. 6 is the flow chart showing the operation of the air conditioner.

Referring to FIG. 1, a microcomputer built-in control apparatus 2 comprises an inputting unit 3 that inputs information from a remote controller 1 for setting parameters such as operation modes, temperature, humidity, and wind speed (defined as operating conditions of the air conditioner) by the user, a memory unit 5 that stores various control setting values or programs, a CPU 4 that executes calculation process and determination process, and an outputting unit 6 that outputs to the displaying apparatus 7 the calculated result and the determined result of the CPU 4. The operation mode includes a cooling operation mode, a heating operation mode, a dehumidifying operation mode, a ventilation operation mode, and an air purifying operation mode.

Although not illustrated in FIG. 1, to measure an actual electricity consumed by the air conditioner, information on the components of the air conditioner that consumes electricity (for example, an electricity consumption of the outdoor unit provided with a compressor that occupy a large portion of the electricity consumption of the air conditioner) is input to the inputting unit 3 as required.

Meanwhile, the remote controller 1, serving as a remote operation device, is used by the user in setting the operation conditions of the air conditioner or the operation modes. A means for setting by the user is not limited to the remote controller 1. As long as it can input the settings, for example, a switch provided on the main body of the air conditioner, may be used to set the conditions.

Subsequently, functions of the control apparatus 2 (the microcomputer) of the air conditioner of the first embodiment will be described with reference to FIGS. 2 to 6. Various operations and processes as set forth below are performed by executing programs installed in the control apparatus 2 (the microcomputer) provided to the air conditioner. Accordingly, a subject of the operations is the control apparatus 2. In each operation, the term "the control apparatus 2" may be abbreviated herein.

The control apparatus 2 of the air conditioner starts an operation of the air conditioner by switching a power of the air conditioner ON, and the air conditioner consumes electricity. The consumed electricity is integrated and stored for each operation mode on a recent stored energy usage storing unit 9, as stored energy usage.

Concurrently, an operation time is integrated and stored for each operation mode on a recent accumulated operation time storing unit 8, as an accumulated operation time.

Also, a set parameter that the user sets by using the remote controller 1 is stored for each operation mode on a recent average setting storing unit 10, as a time weighted averaged data.

A time weighted average processing means that the average processing is executed by using the subsequent equation (1).

$$Mz \times Mx/(Mx+T)+Nz \times T/(Mx+T) \quad \text{[Equation 1]}$$

where

Mx: an accumulated operation time, stored

Mz: a set parameter, stored

Nz: a set parameter, being set at the present time

T: a time interval for the time weighted average processing

That is, a weighting that considers a time Mx taken until reaching the current memory content among the total accumulated time Mx+T is performed to a set parameter Mz stored on the memory unit 5. A weighting that considers only the averaged time interval T (a time interval from the previous averaging processing to the average processing at the present time) among the total accumulated time Mx+T is performed to a set parameter Nz being set at the present time, and both of them are added. In this way, a set parameter for the actual usage by the user and a duration of the air conditioner being used at this setting are taken into account, and the set parameter set by the user, from moment to moment, can be stored and updated.

Although not illustrated in the drawings, the recent accumulated operation time storing unit 8, the recent stored energy usage storing unit 9, and the recent average setting storing unit 10 are secured for each operation mode. Their stored parameters are managed for each operation mode.

Further, in the recent stored energy usage storing unit 9, a specific method for integrating and storing the electricity consumption will be described with reference to FIG. 3.

FIG. 3 illustrates the stored energy usage storing memory units that store the stored energy usage in a horizontal direction. In this example, six stored energy usage storing memory units A to F are secured. These are not particularly limited to six, and an arbitrary number may be secured.

Each one of the stored energy usage storing memory units has a prescribed unit time. The electricity consumption is integrated at any time to an stored energy usage storing memory unit in target until the prescribed unit time elapses. After the prescribed unit time elapses, the electricity consumption is changed to the next stored energy usage storing unit. Every time the prescribed unit time elapses, the stored energy usage storing memory unit to be stored continues to change.

For example, in FIG. 3, the stored energy usage storing memory unit A is used as the stored energy usage storing memory unit to be integrated first. The electricity consumption continues to be integrated to the stored energy usage storing memory unit A (corresponds to a line 1 of the currently in process indicated on the vertical axis on FIG. 3) until the prescribed time elapses.

When the prescribed unit time elapses with an elapse of time, the electricity consumption continues to change to the stored energy usage storing memory unit B (corresponds to a line 2 of the currently in process position indicated on the vertical axis on FIG. 3).

Each time the prescribed unit time elapses successively, the stored energy usage storing memory unit to be stored is changed. When the last stored energy usage storing memory unit F is reached (corresponds to a line 6 of the currently in process position indicated on the vertical axis on FIG. 3), after an elapse of the next prescribed unit time, a content of the stored energy usage storing memory unit A is cleared to store the electricity consumption at any time (corresponds to a line 7 of the currently in process position indicated on the vertical axis on FIG. 3). When the last one of the stored energy usage storing memory unit previously prepared is reached, the process overwrites, the first stored energy usage storing memory unit.

By taking a total sum of the electricity consumptions integrated to individual stored energy usage storing memory units that are processed accordingly, the stored energy usage within a predetermined time can be calculated retroactively from the present time. That is, the recent stored energy usage is calculated at all times by calculating the total sum of the individual stored energy usage storing memory units.

The recent accumulated operation time can be calculated from the equation (2), because the prescribed unit time of the individual stored energy usage storing memory units is fixed.

The content of processing of the recent accumulated operation time storing unit 8 is processed as indicated below in equation (2).

[a predetermined unit time]×[a number of accumulated electricity storing memory units after processing−1]+[a time elapsed from a start of storing on the stored energy usage storing memory unit currently in process to a current point] [Equation 2]

For example, provided that the prescribed unit time (each one of the predetermined times) of the stored energy usage storing memory units A to F is 10 hours, the electricity consumption of the air conditioner is integrated to a target, the first stored energy usage storing memory unit A, until an operation time under the same operation mode elapses 10 hours. When the operation time under the same operation mode exceeds 10 hours, at this point, the process integrates the stored energy usage to the next stored energy usage storing memory unit B, not to the stored energy usage storing memory unit A. After this, every time the operation time under the same operation mode elapses 10 hours, the stored energy usage storing memory unit to be stored is changed. When the stored energy usage storing memory unit F is reached, the process returns to the stored energy usage storing memory unit A, and integrates and overwrites after a stored value of the stored energy usage storing memory unit A is cleared.

Now, provided that the actual accumulated operation elapse time under the same operation mode is 75 hours, a position of the stored energy usage storing memory unit which is currently in process corresponds to the stored energy usage storing memory unit B. A sequence of events of the memory units of the stored energy usage until reaching this state is as follows: integrated values of an stored energy usage storing memory unit A→an stored energy usage storing memory unit B→an stored energy usage storing memory unit C→an stored energy usage storing memory unit D→an stored energy usage storing memory unit E→an stored energy usage storing memory unit F→the stored energy usage storing memory unit A are cleared; an integrated value of overwriting integration→the stored energy usage storing memory unit B is cleared; and at a present time, the stored energy usage up to the 5th hour has been overwritten.

Accordingly, the stored energy usage storing memory units A to F are stored as stored data of the stored energy usage. The corresponding accumulated operation time is calculated from equation (2) as $10\times(6-1)+5=55$ hours.

That is, the stored energy usage of the recent 55 hours operated at this operation mode is worked out retroactively by calculating the total sum of the stored energy usage storing memory units A to F. The recent stored energy usage can be worked out accordingly (in this example, the stored energy usage of the recent 55 hours).

Meanwhile, when the operation of the air conditioner stops halfway, storage of the stored energy usage and the operation time temporarily stop at that point. When restarting the same operation under the same operation mode again, the storage of the stored energy usage and the operation time restart, continued from the stopped point of the previous operation.

Accordingly, an actual usage electricity efficiency calculating unit 12 of FIG. 2 calculates the actual electricity consumption from the recent accumulated operation time storing unit 8 and the recent stored energy usage storing unit 9 where various data are processed and managed. That is, the actual usage electricity efficiency calculating unit 12 calculates the actual electricity consumption based on the actual usage of the air conditioner by the user, out of a stored value of the recent accumulated operation time storing unit 8 and a stored value of the recent stored energy usage storing unit 9.

As used herein, the electricity efficiency means the electricity consumed per unit time (the accumulated electricity per unit time), and is calculated by dividing the consumed stored energy usage by the usage period.

That is, the electricity efficiency is calculated by dividing the stored value of the recent stored energy usage storing unit 9 by the stored value of the recent accumulated operation time storing unit 8. The electricity efficiency, as described previously, is calculated and managed for each operation mode.

Moreover, a setting comparing unit 13 of FIG. 2 compares a stored content of the recent average setting storing unit 10 with a set parameter set by the user at the start of operation, in other words, the set parameter of a setting for at the present time 11 of FIG. 2.

The considerate items of the set parameter include the temperature, the humidity, the wind speed, and so forth on. Only the item that is most relevant in the electricity consumption may be targeted, or a plurality of setting items may be combined.

Needless to say that the recent average setting storing unit 10, the setting for the present time 11, and the setting comparing unit 13 must be prepared for storing, managing, and comparing the individual set parameters, depending on the individual set parameters, when a plurality of setting items are targeted.

Also, the setting comparing unit 13 executes the comparing method by calculating a difference between the stored content of the recent average setting storing unit 10 and the set parameter of the setting for the present time 11. In cases where the electricity consumption of the air conditioner can be reduced by making a setting high (for example, the setting temperature during the cooling operation), the following equation (3) is calculated:

[a compared result of the setting comparing unit 13]=[a set parameter for the present time]−[a set parameter of the stored value] [Equation 3]

In cases where the electricity consumption of the air conditioner can be reduced by making a setting low (for example, the setting temperature during the heating operation), the following equation (4) is calculated:

[a compared result of the setting comparing unit 13]=[a set parameter of stored value]−[a set parameter for the present time] [Equation 4]

Next, a content of the processing of a predicted electricity efficiency speculating unit 14 of FIG. 2 will be described with reference to FIG. 4. The predicted electricity efficiency speculating unit 14 speculates an electricity efficiency predicted depending on the set parameter set by the user at the present time, based on a calculated result of the actual usage electricity efficiency calculating unit 12 and a compared result of the setting comparing unit 13.

In specific terms, a speculation calculating process is performed by modifying the calculated result of the actual usage electricity efficiency calculating unit 12 shown in FIG. 4, by responding to the compared result of the set parameter processed by the setting comparing unit 13 of FIG. 2. That is, in FIG. 4, a column designated as a temperature difference (° C.) corresponds to the compared result of the set parameter processed by the setting comparing unit 13, and a column designated as a change ratio (%) corresponds to a modified ratio that modifies the calculated result of the actual usage electricity efficiency calculating unit 12.

In this example, the set parameter to be stored is a temperature setting since the temperature setting largely influences a change in the electricity consumed by the air conditioner during the cooling operation or the heating operation. This is the reason why an item on the leftmost column of FIG. 4 is the temperature difference (° C.). However, the item is not particularly limited to the temperature setting, for instance, the humidity setting may be targeted for the dehumidifying operation, the air speed setting may be targeted for the air purifying operation (the ventilation operation), alternatively, these setting elements may be targeted in combination. A unit of the temperature difference is denoted "° C.", or "deg".

When a setting element other than the temperature setting is targeted, there is a need for a replacement to correspond to the set parameters of the respective targets. Needless to say that such a replacement is carried out in the likewise manner as the case of the temperature setting of FIG. 4. Also, a table of FIG. 4 may be prepared for each operation mode, despite of it being the same setting element.

The change ratio (%) of FIG. 4 sets change rates, as numerical values, of the electricity consumption per 1° C. temperature difference, which is experimentally verified in advance. In terms of the electricity consumption relating to the temperature setting of the air conditioner, it has been experimentally or generally recognized that there is an energy saving effect of 10% per 1° C. temperature setting. By way of illustration, such a numerical value is set to each change amount 0 to 10 in advance.

In addition, the table of FIG. 4 illustrates only the temperature difference for a positive value, however, it may include a negative value if the temperature difference shows the negative value.

Moreover, when the temperature difference is the positive value, the format shown in FIG. 4 may be used accordingly. When the temperature difference is the negative value, all information on FIG. 4 may be interpreted by attaching a minus sign. The format of the table shown in FIG. 4 is not particularly limited.

Also, FIG. 4 only illustrates the case in which the temperature difference is a whole number. When the temperature difference is a numerical value including a decimal point, the temperature difference may be calculated by interpolating them closest numerical values before and after the numerical value.

To give an example, when a set parameter targeted in the recent average setting storing unit 10 and the setting for the present time 11 is the temperature setting in the cooling operation, provided that a stored value of the recent average setting storing unit 10 is 25° C., and a set value of the setting for the present time 11 is 26° C., then a difference between the average value of the actual usage of the temperature setting that the user actually used recently (25° C.) and the temperature setting which is about to be operated at the present time (26° C.) is output. By way of the previously described contents, currently, the difference is 1° C. Referring to FIG. 4, when the temperature difference is 1° C., the change ratio is 1%, the change rate at the change amount 1=10% is obtained from a relation of the previously described temperature setting and the electricity consumption. Therefore, in this case, a result that the change rate is set to 10% is acquired. When the predicted electricity efficiency speculating unit 14 obtains this result, it modifies the calculated result of the actual usage electricity efficiency calculating unit 12 by using the calculated change ratio. Specifically, it is calculated by using the subsequent equation (5) as below:

$$[\text{a predicted electricity efficiency}]=[\text{an actual usage electricity efficiency}]\times[100-\text{change ratio}]/100 \quad \text{[Equation 5]}$$

For example, when the calculated result of the actual usage electricity efficiency calculating unit 12 is 0.178 [kWh/h], it is modified to 0.160 [kWh/h], which is a value deduced by 10%. This value becomes a numerical value outputted by the predicted electricity efficiency speculating unit 14.

According to this prediction method, the prediction is made based on the actual usage of the air conditioner by the user, and the prediction can be made by taking into account of various air conditioning loads that are different for each building structure and type, and for different climates (the outside air environment). That is, the prediction is made based on the electricity consumption actually consumed at a dwelling of the user, and at a seasonal environment recently used by the user. Accurate prediction that counterbalances the actual conditions is possible.

Next, a predicted electricity charge efficiency calculating unit 16 calculates an electricity efficiency as an electricity charge (the electricity charge per unit time), based on the speculated result of the predicted electricity efficiency speculating unit 14 and a stored value of an electricity unit price storing unit 15.

Herein, the electricity unit price storing unit 15 stores an electricity unit price (the electricity charge per 1 kWh electricity) on the memory unit 5 of FIG. 1. Since the electricity unit price differs depending on a contract between the user and the electric company, also, it differs for different electric companies, the user can change the electricity unit price at any one time. When the change is made, the changed value is re-stored as the electricity unit price. The remote controller 1 is operated by the user in making the change of the electricity unit price.

A content of the calculation actually made by the predicted electricity charge efficiency calculating unit 16 is as shown below in equation (6):

$$[\text{a predicted electricity charge efficiency}]=[\text{a predicted electricity efficiency}]\times[\text{an electricity unit price}] \quad \text{[Equation 6]}$$

Provided that the electricity unit price=22 yen/kWh, and the predicted electricity efficiency=0.160 kWh/h, a resultant is the predicted electricity efficiency=3.52 yen/h.

Next, in FIG. 2, the displaying unit 17 performs a displaying process to display the result calculated by the predicted electricity charge efficiency calculating unit 16 on the displaying apparatus 7. In specific terms, it performs a process whereby each display element of the displaying apparatus 7 is light on or light off, and a process whereby the calculated result of the predicted electricity efficiency calculating unit 16 is adjusted to a format compatible to the displaying format of the displaying apparatus 7.

Examples of the displaying apparatus 7 includes: a displaying apparatus 7 provided to the main body of the air conditioner, having a displaying format shown in (a) of FIG. 5. The displaying apparatus 7, shown in (a) of FIG. 5, possesses a function that displays, for example, the current temperature as shown in (b) of FIG. 5, during the normal operation. As the occasion demands, the displaying apparatus 7 can display various information by lighting up the corresponding display elements only.

For example, when the resultant of the calculation of the predicted electricity charge efficiency calculating unit 16 is 3.52 yen/h, the display format of the displaying apparatus 7 is as shown in (a) of FIG. 5. The displaying unit 17, among the display elements shown in (a) of FIG. 5, lights up the display elements of ¥, the currency unit for yen, lights up the display element of "/h", an efficiency per unit time, lights up "3.5" by rounding off the numerical value of 3.52, and lights up the display elements of a Japanese character 月 which indicates monthly data. All other displaying elements are light off. Accordingly, the electricity charge information is displayed eventually as in (c) of FIG. 5 on the display apparatus 7, to be presented to the user.

As used herein, the displaying apparatus 7 is provided on the main body of the air conditioner. However, it may be made to be displayed on the remote controller 1 or the like. The position of providing the displaying apparatus 7 is not particularly limited. Also, a display format of the displaying apparatus 7 is not particularly limited to the display format shown in (a) of FIG. 5.

Moreover, in the above description, the electricity charge is explained; however, it may be replaced with an amount of CO2 emissions. The amount of CO2 emissions expresses the amount of CO2 (the carbon dioxide) generated at the electric power plant upon producing the electricity consumed by this air conditioner. Normally (generally), the carbon dioxide is abbreviated as CO2, however, the present specification denotes as CO2.

The case with the amount of CO2 emission is similar to the case of electricity charge described above, except that the electricity unit price storing unit 15 is replaced with a CO2 emission coefficient storing unit for storing a CO2 emission coefficient, which will be described later, and the predicted electricity charge efficiency calculating unit 16 is replaced with a predicted amount of CO2 emission efficiency calculating unit. Then, the displaying unit 17 is changed to display the result of the amount of CO2 emission efficiency as shown in (d) of FIG. 5 to the displaying apparatus 7.

The CO2 emission coefficient expresses an amount of CO2 evolved per 1 kWh of electricity consumption. An amount of CO2 emission efficiency is calculated in the same way as the electricity charge efficiency. That is, the amount of CO2 emission efficiency is calculated by multiplying the electricity efficiency and the CO2 efficiency coefficient.

For example, the CO2 emission coefficient of 0.40 kg/kWh is meant that a conversion coefficient for generating 400 g of CO2 per 1 kWh of electricity consumption. The amount of CO2 emission efficiency (the amount of CO2 emission per unit time) is calculated by replacing this CO2 emission coefficient with [an electricity unit price] of the equation (6).

Provided that the CO2 emission coefficient=0.40 kg/kWh and the predicted electricity efficiency=0.1588 kWh/h, then a resultant is the amount of CO2 emission efficiency, 0.1588 kWh/h×400 g/kWh=63.5 g/h.

The displaying unit 17, among the display elements of the displaying apparatus 7 as shown in (a) of FIG. 5, lights up display elements of "CO2" that conveys the display of the amount of CO2 emission, lights up display elements indicating efficiency per unit time [/h], lights up "63.5" as the numerical value of the calculated result 63.5, and lights up an unit amount "g" (grams). The displaying unit 17 is processed to eventually display the displaying results on the displaying apparatus 7 as in (d) of FIG. 5, and present the information on the amount of CO2 efficiency to the user.

It suffices to have at least either one of the electricity unit price storing unit 15 or the CO2 emission coefficient storing unit.

Likewise, it suffices to have at least either one of the predicted electricity charge efficiency calculating unit 16 or the predicted amount of CO2 emission efficiency calculating unit. In a case in which the CO2 emission coefficient storing unit and the predicted amount of CO2 emission efficiency calculating unit are not provided but the electricity charge storing unit 15 and the predicted electricity charge calculating unit 16 are provided, the amount of CO2 emission efficiency cannot be displayed on the displaying apparatus 7. In reverse, the electricity charge efficiency cannot be displayed on the displaying apparatus 7.

This is similar to the case of displaying, not as the electricity charge or the amount of CO2 emission, but directly as the stored energy usage per unit time. In this case, the electricity unit price storing unit 15 and the predicted electricity charge efficiency calculating unit 16, that multiplies the stored value of the electricity unit price storing unit 15 to the speculated result of the speculated electricity efficiency speculating unit 14, are not required. It may be operated so that the speculated result of the speculated electricity efficiency speculating unit 14 is displayed as it is.

We have so far described on the methods of processing, managing and storing various data for calculating the predicted electricity charge efficiency, and the method of displaying the final outcomes. Next, we will describe a flow starting from a step of outputting the operation start instruction to the air conditioner by the user operating the remote controller 1 (switching the power ON), to a step of presenting the information to the displaying apparatus 7.

Referring to FIG. 6, in step S101, the user switches the power ON with the remote controller 1 and instructs a start of the operation of the air conditioner. In step S102, the electricity charge per unit time is predicted, as described in the control block process of FIG. 2. In step S103, the predicted electricity charge efficiency is displayed on the displaying apparatus 7. The user can acquire information on how much the electricity charge will be spent per unit time under his/her setting at the present time by visually confirming the displayed value.

Also, in addition to displaying the electricity charge efficiency on the displaying apparatus 7 of step S103, the process also starts counting a displaying period of the electricity efficiency in step S104. This displaying period is a pre-set time value stored on the memory unit 5. When a time count value passes this pre-set time value (S106 of FIG. 6), in step 107, the process operates (S107 of FIG. 6) to show a normal display mode (displays the current temperature in this example) shown in (b) of FIG. 5.

On the other hand, when a set parameter is changed before the time count value attains the pre-set time value (in this example, when the temperature setting is changed), the process operates to re-predict and re-display the electricity charge efficiency, (corresponds to a returning flow from step S105 to S102 in FIG. 6). In this way, the user can acquire the electricity charge operated under this set parameter set by the user.

Meanwhile, the content concerning the electricity charge has been described herein. Needless to say, the information to be presented can be the amount of CO2 efficiency or the electricity efficiency itself, to be processed in a manner just as the previously described case with the electricity charge efficiency.

In addition, the types of displaying information displayed can be set in advance by the remote controller 1 or the like, and the information can be displayed in accordance with the set parameter. The information to be displayed can be selected from any one of (1) "electricity charge efficiency", (2) "amount of CO2 emission efficiency", (3) "electricity efficiency", or (4) "does not display any one of (1), (2) and (3)". The process operates to display the selected information. Meanwhile, when the process selects (4) "does not display any one of (1), (2) and (3)", it advances directly to step S107, not to step of S102 which is the next step of S101. Since the efficiency display finishes in step S107, so that after this step, the normal display, for example, the display of the current temperature is performed, when (4) is selected, at the start of operation, and the current temperature is displayed without displaying the efficiency prediction information of (1), (2) and (3). In this way, when any one of (1), (2) or (3) is selected, and after the efficiency prediction information of anyone of (1), (2) or (3) is displayed at the start of operation, it becomes possible to switch automatically to the current temperature display. When the CO2 emission coefficient storing unit and the predicted amount of CO2 emission efficiency calculating unit are not provided but the electricity charge storing unit 15 and the predicted electricity charge calculating unit 16 are provided, since the amount of CO2 emission efficiency cannot be displayed on the displaying apparatus 7, so that the selection item (2) is omitted in advance. In reverse, since the electricity charge efficiency cannot be displayed on the displaying apparatus 7, so that the selection item (1) is omitted in advance.

As described above, in the first embodiment, the estimation of the electricity efficiency is made based on the recent actual usage that the user has actually used. It therefore produces the effect that the estimation of a precise and appropriate efficiency compatible to a housing environment of the user, a region, the actual usage, and the external environment, without being influenced by various air conditioning loads that are different for building functions and regional climates.

Also, the electricity efficiency estimation is made based on the recent data. It therefore produces the effect that the accuracy of the estimated result does not decline over a long term due to prominent changes in the external environment.

Meanwhile, there is no actual usage data at an initial usage period straight after the user purchases the air conditioner. Under such circumstance, the electricity efficiency of the initial condition stored in advance (stored on the memory unit 5) is used until a prescribed period elapses. The initial usage period after the purchase is dealt with by displaying this standard as a general efficiency.

Also, various data are processed, managed and stored for each operation mode, so that the electricity consumption per unit time for the individual operation mode can be calculated. It therefore produces the effect of presenting an accurate value for each operation mode set by the user, compared with the case of not managing the data for each operation mode.

Also, the electricity efficiency is automatically displayed at the time of switching the power ON. It therefore brings about the effect on the user to save energy and increase the awareness towards the reduction of environmental burden, compared with the case of presenting the display only when the user has requested it.

Also, when the setting is changed during the display of the electricity efficiency, the electricity efficiency that reflects on a newly set parameter is re-predicted. The user can visually confirm how much influence his/her setting have on the extents of energy saving and environmental burden reduction. It therefore brings about the effect on the user to save energy and increase the awareness towards the reduction of environmental burden.

Also, the content of the information to be displayed is selected depending on the user's intention. It therefore produces the effect of meeting the user demand for information presentation of various kinds.

Second Embodiment

The first embodiment has described the way in which the information concerning electricity efficiency has been presented at the start of operation. In addition to the content of the first embodiment, the second embodiment will be described with reference to FIGS. 7 to 9 that display information concerning energy consumed by the air conditioner at an end of the operation.

Figure 7:
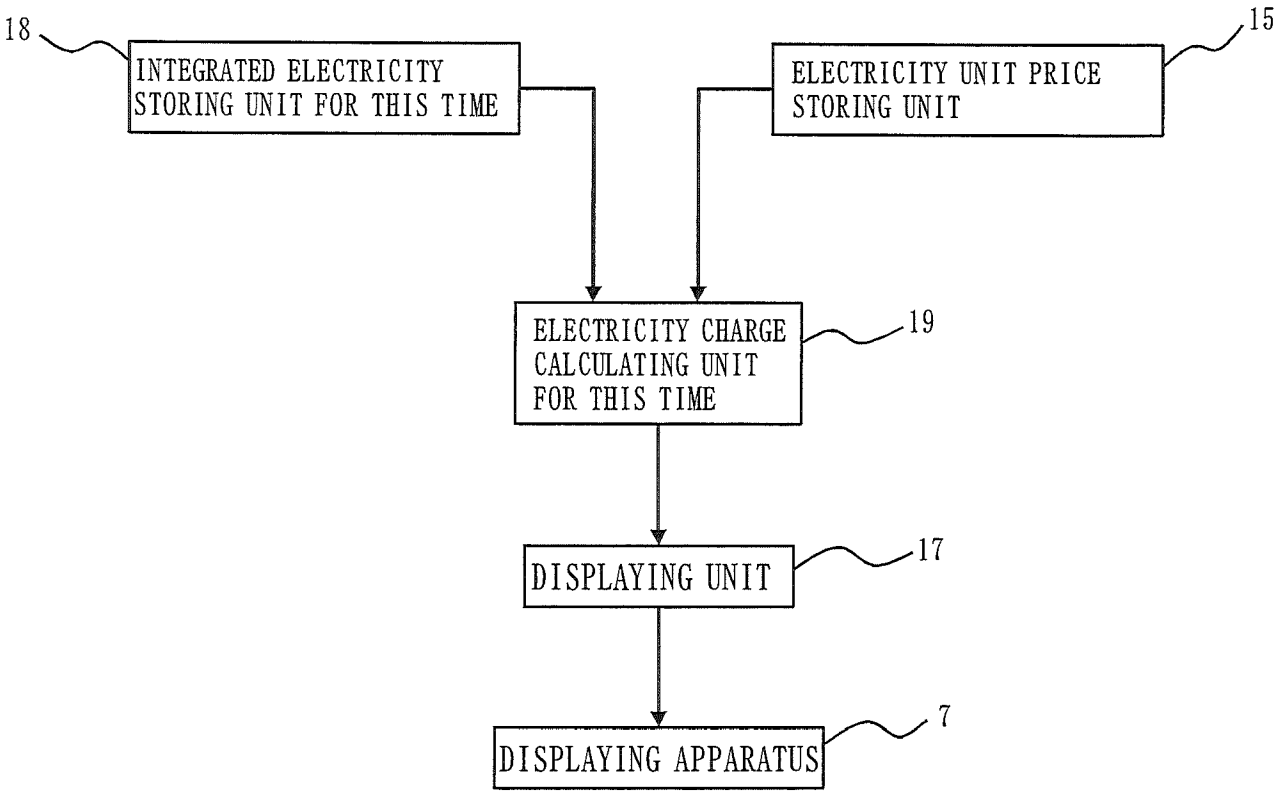
FIG. 7 is a control block chart showing a control of the air conditioner, in accordance with a second embodiment.
Figure 8:
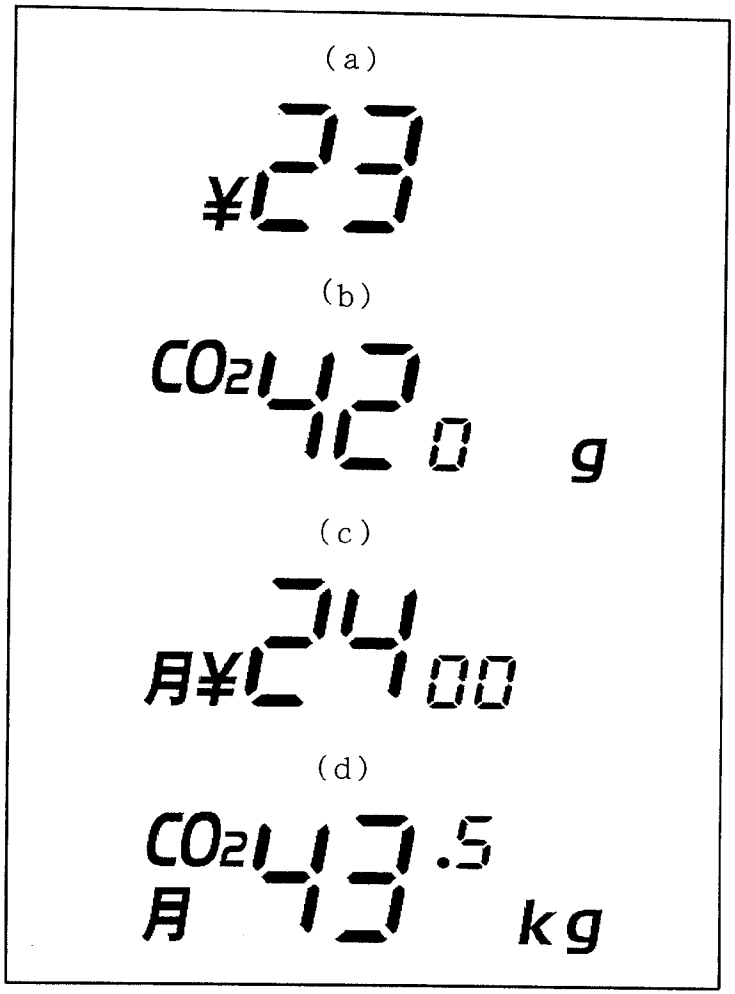
FIG. 8 illustrates examples of display elements of the displaying apparatus of the air conditioner, which include (a) an example of displaying an electricity charge in use at the present time, (b) an example of displaying an amount of CO2 emission released from the electricity consumption in use at the present time, (c) an example of displaying an electricity charge consumption of this month, and (d) an example of displaying an amount of CO2 emission released from the electricity consumption of this month, in accordance with the second embodiment.
Figure 9:
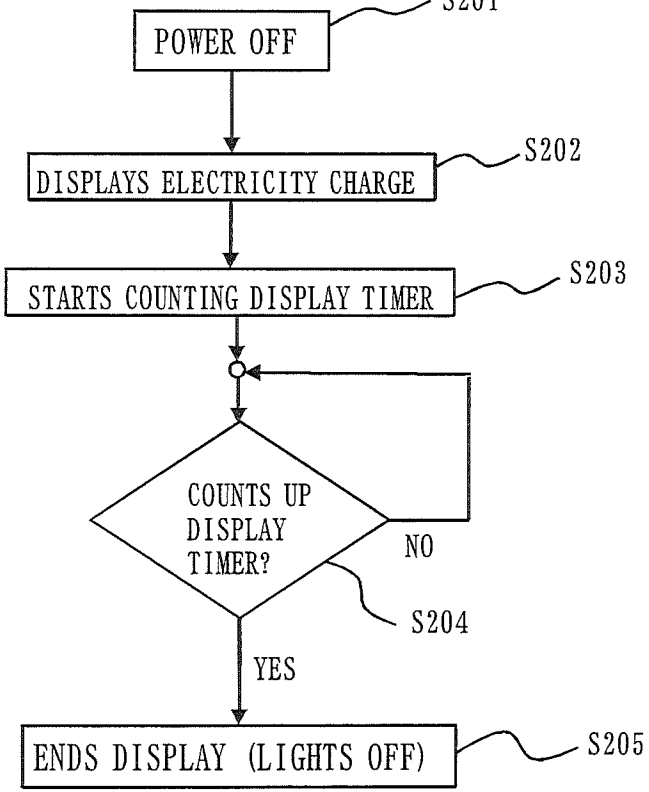
FIG. 9 is a flowchart showing an operation of the air conditioner, in accordance with the second embodiment.

FIGS. 7 to 9 illustrate the second embodiment. FIG. 7 is the control block chart showing the control of the air conditioner. FIG. 8 illustrates the examples of display elements of the displaying apparatus of the air conditioner, which include (a) the example of displaying the electricity charge in use at the present time, (b) the example of displaying the amount of CO2 emission released from the electricity consumption in use at the present time, (c) the example of displaying the electricity charge consumption of this month, and (d) the example of displaying the amount of CO2 emission released from the electricity consumption of this month, in accordance with the second embodiment. FIG. 9 is the flowchart showing the operation of the air conditioner.

The basic configuration of the air conditioner is the same as the first embodiment, so that the explanation of the basic configuration is omitted in this embodiment. The same reference numerals are attached to the portion that are equivalent to the first embodiment so that their explanations are omitted.

Referring to FIG. 7, an stored energy usage storing unit 18 for the present time integrates an electricity consumption of the air conditioner, during a period between switching the power ON and OFF by the user, and performs a process of storing it to the memory unit 5. When the user switches the power OFF to stop using the air conditioner, an electricity charge calculating unit 19 for the present time calculates, based on a stored value of the stored energy usage storing unit 18 for the present time and the stored value of the electricity unit price storing unit 15, the electricity charge incurred, during a period starting from the power ON at the present time and ending at power OFF, by using the equation (7) below:

[an electricity charge for the present time]=[a stored value of the stored energy usage storing unit 18]×[an electricity unit price] [Equation 7]

Provided that the stored value of the stored energy usage storing unit 18 for the present time is 1.045 kWh when the electricity unit price=22 yen/kWh, a resultant is the electricity charge for the present time=23 yen. When the electricity charge for the present time is calculated accordingly, the displaying apparatus 17 performs a process for displaying this result to the displaying apparatus 7. The displaying apparatus 7 of this embodiment is the displaying apparatus 7 of the first embodiment having the same displaying format as shown in (a) of FIG. 5. The result for at the present time of 23 yen is displayed on the displaying apparatus 7 as shown in (a) of FIG. 8 in accordance to the process of the displaying unit 17. The information is presented to the user accordingly.

In the present example, the case of displaying the electricity charge has been described. Alternatively, the amount of CO2 emission may also be displayed. In such a case, similar to the case of the electricity charge, the electricity unit price storing unit 15 is replaced with the CO2 emission coefficient storing unit that stores the CO2 emission coefficient, and the electricity charge calculating unit 19 for the present time is replaced with the amount of CO2 emission calculating unit for the present time. Then, the displaying unit 17 is changed to display the result of the amount of CO2 emission for the present time shown in (b) of FIG. 8 to the displaying apparatus 7.

For example, the CO2 emission coefficient is 0.40 kg/kWh, and this CO2 emission coefficient is replaced with the "an electricity unit price" of the equation 7, and the amount of CO2 emission for the present time is calculated.

Provided that the CO2 emission coefficient=0.40 kg/kWh, and the stored value of the stored energy usage storing unit 18 for the present time is 1.050 kWh, a resultant is the amount of CO2 emission for the present time=420 g. When the CO2 emission amount for the present time is calculated accordingly, the displaying unit 17 displays the result to the displaying apparatus 7. This displaying apparatus 7 is the displaying apparatus 7 of the first embodiment having the same display format as (a) of FIG. 5. The result for the present time (420*g*) is displayed on the displaying apparatus 7 as shown in (b) of FIG. 8 in accordance to the process of the displaying unit 17, thereby presenting the information to the user.

It is sufficient to have at least either one of the electricity unit price storing unit 15 and the CO2 emission coefficient storing unit.

Likewise, it is sufficient to have at least either one of the electricity charge calculating unit 19 for the present time and the amount of CO2 emission calculating unit for the present time. When the CO2 emission coefficient storing unit and the predicted amount of CO2 emission efficiency calculating unit are not provided but the electricity charge storing unit 15 and the electricity charge calculating unit 19 for the present time are provided, then the amount of CO2 emission for the present time cannot be displayed on the displaying apparatus 7. In reverse situation, the electricity charge for the present time cannot be displayed on the displaying apparatus 7.

The same can be said in the case of displaying the electricity consumption for the present time directly, not as the electricity charge or the amount of CO2 emission. In this case, the electricity unit price storing unit 15 of FIG. 7 and the electricity charge calculating unit 19 for the present time are not necessary. The calculated result of the stored energy usage storing unit 18 for the present time is displayed as it is.

Alternatively, rather than displaying the information as the amount of usage at the present time, an electricity charge of this month incurred to the current day may be displayed as (c) of FIG. 8, and an amount of CO2 emission of this month released to the present day may be displayed as (d) of FIG. 8. Herein, the electricity charge of this month means the electricity charge starting from a prescribed day and ending at the present day. The amount of CO2 emission of this month means an integrated value of the amount of CO2 emission starting from a prescribed day and ending at the present day. The prescribed day can arbitrary be set by the user. However, the duration is limited due to the limitation in a capacity of the storing unit. Generally, an electricity bill from the electric company is issued on a monthly basis, by setting the first day of that month as the prescribed day, where a percentage of the electricity charge of this air conditioner that occupy the electricity charge of a dwelling can be acquired as a highly usable information to the user.

In addition, in case of displaying it as a value of this month, needless to say that there is the need to add on a step of storing the stored energy usage of this month, just like the stored energy usage storing unit 18 for the present time, to the control block chart of FIG. 7.

Next, a flow starting from outputting the operation stop instruction to the air conditioner after switching the power OFF by the user, and ending at finishing the whole operation will be described.

Referring to FIG. 9, in step S201, when the user outputs an operation stop instruction to the air conditioner by switching the power OFF with the remote controller 1, in accordance with the control block processing indicated in FIG. 7, the result that calculated the electricity charge incurred by using the preset air conditioner as described previously, is displayed on the displaying apparatus 7 in step S202.

In addition, the display is displayed for a prescribed time only, and a time count starts in S203. This displaying time is a pre-set time value previously stored on the memory unit 5, and when a time count value becomes greater than this pre-set time value (S204), the whole operation ends and the display disappears (S205). On the other hand, the same display continues until the time count value reaches the pre-set time value.

Meanwhile, a type of the information can be set in advance by using the remote controller 1 or the like. The advantage of displaying information in accordance to the set parameter is the same as that of the first embodiment. For example, the displaying information can be selected from any one of (1) "the electricity charge incurred, a period starting from the power ON at the present time and ending at power OFF"; (2) "the amount of CO2 emission, a period starting from the power ON at the present time and ending at power OFF"; (3) "the electricity consumption of the corresponding air conditioner, a period starting from the power ON at the present time and ending at power OFF"; or (4) "does not display any one of (1), (2) and (3)". The selected information is displayed. Meanwhile, when (4) "does not display any one of (1), (2) and (3)" is selected, the process advances directly to step S205, not to step of S202 which is the next step of S201. This point is the same as the first embodiment. When the CO2 emission coefficient storing unit and the amount of CO2 emission calculating unit for the present time is not provided but the electricity unit price storing unit 15 and the electricity charge calculating unit 19 for the present time are provided, since the amount of CO2 emission for the present time cannot be displayed on the displaying apparatus 7, thus the selection item (2) is omitted in advance. In reverse, since the electricity charge for the present time cannot be displayed on the displaying apparatus 7, thus the selection item (1) is omitted in advance.

As described above, in the second embodiment, in addition to the operation of the first embodiment, the electricity charge spent at the present time, or the amount of CO2 emission, or the electricity consumption itself, is automatically displayed upon stopping the operation of the air conditioner. The user can confirm how much energy is consumed by his/her setting made at the start of operation, in accordance with the operation of the first embodiment. The actual energy consumption, starting from the power ON at the present time to ending at power OFF, is confirmed at the time of stopping the operation, based on the operation content of the second embodiment. Compared with the first embodiment that only displays the predicted efficiency depending on the set parameter of the user at the start of operation, the second embodiment produces the effects of a profound understanding concerning the energy consumption of the air conditioner by the user, saving energy and increasing the awareness of reducing the environmental burden by the user.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

What is claimed is:

1. An air conditioner, comprising:

a setting apparatus that sets an operation mode which a user requests to the air conditioner or an operation condition of the air conditioner for the operation mode;

a control apparatus with a built-in microcomputer having an inputting unit that inputs information from the setting apparatus, a memory unit that stores various control setting values and programs, a CPU that performs a calculation process and a determination process, and an outputting unit that outputs a calculated result and a determined result from the CPU; and a displaying unit that displays the outputs from the outputting unit;

wherein the control apparatus comprises:

a recent stored energy usage per unit time storing unit that stores electricity consumed by the air conditioner, as stored energy usage per unit time, for each operation mode;

a recent accumulated operation time storing unit that stores an operation time of the air conditioner, as an accumulated operation time, for each operation mode;

an actual usage electricity efficiency calculating unit that calculates an electricity efficiency, which is a stored energy usage per unit time for the actual usage, based on a stored value of the recent stored energy usage per unit time storing unit and a stored value of the recent accumulated operation time storing unit;

a recent average setting storing unit that stores a set parameter set with the setting apparatus by the user, as a time weighted averaged data, for each operation mode;

a setting comparing unit that compares a stored content of the recent average setting storing unit with a set parameter set by the user at a present time at a start of operation;

a predicted electricity efficiency speculating unit that speculates the electricity efficiency predicted as a result of the set parameter set at the present time by the user, based on a calculated result of the actual electricity efficiency calculating unit and a compared result of the setting comparing unit; and at least one of an electricity unit price storing unit that stores an electricity unit price on the memory unit or a CO2 emission coefficient storing unit that stores a CO2 emission coefficient;

at least one of a predicted electricity charge efficiency calculating unit that calculates an electricity charge efficiency, which is an electricity charge per unit time, based on a speculated result of the predicted electricity efficiency speculating unit, and a stored value of the electricity unit price storing unit, or a predicted amount of CO2 emission efficiency calculating unit that calculates an amount of CO2 emission efficiency, which is an amount of CO2 emission per unit time, based on the speculated result of the predicted electricity efficiency speculating unit and the stored value of the CO2 emission coefficient storing unit; and wherein any one of predicted information including the electricity charge efficiency calculated by the predicted electricity charge efficiency calculating unit, or the amount of CO2 emission efficiency calculated by the predicted amount of CO2 emission efficiency calculating unit, or the electricity efficiency speculated by the predicted electricity efficiency speculating unit, is displayed on the displaying apparatus, at the start of the operation of the air conditioner.

2. The air conditioner according to claim 1, wherein the control apparatus displays on the displaying apparatus any of the predicted information including the electricity charge efficiency or the amount of CO2 emission efficiency or the electricity efficiency, at the same time, starts counting a duration of displaying the predicted information, and when a set parameter of the setting apparatus has been changed before the present time counted value reaches a pre-set time value stored on the memory unit, the predicted electricity efficiency speculating unit re-predicts the electricity efficiency based on the set parameter changed, and redisplays on the displaying apparatus any of the predicted information including the electricity charge efficiency or the amount of CO2 emission efficiency or the electricity efficiency.

3. The air conditioner according to claim 1, wherein the setting apparatus can instruct to the control apparatus, to display on the displaying apparatus, any of the predicted information (1) or (2) or (3) or (4), among the following predicted information displayed on the displaying apparatus at the start of operation:

(1) the electricity charge efficiency that the predicted electricity charge efficiency calculating unit calculates;

(2) the amount of CO2 emission efficiency that the predicted amount of CO2 emission efficiency calculating unit calculates;

(3) the electricity efficiency that the predicted electricity efficiency speculating unit speculates; or (4) does not display any one of (1), (2) and (3).

4. The air conditioner according to claim 1, wherein the control apparatus further comprises:

a stored energy usage per unit time storing unit for the present time that stores, at any time, electricity consumption of the air conditioner during a period starting from switching the power ON and ending at the power OFF by the user, in the memory unit;

at least one of an electricity charge calculating unit for the present time that calculates an electricity charge incurred during a period starting from switching the power ON at the present time and ending at power OFF, based on a stored value of the stored energy usage per unit time storing unit for the present time and a stored value of the electricity unit price storing unit, or an amount of CO2 emission calculating unit for the present time that calculates an amount of CO2 emission, during a period starting from switching the power ON at the present time and ending at power OFF, based on the stored value of the stored energy usage per unit time storing unit for the present time and a stored value of the CO2 emission coefficient storing unit; and when the user outputs an operation stop instruction to the air conditioner by switching a power OFF of the setting apparatus, any one of the electricity charge incurred during a period starting from switching the power ON at the present time and ending at power OFF that the electricity charge calculating unit for the present time calculates, or the amount of CO2 emission released during a period starting from switching the power ON at the present time and ending at power OFF that the amount of CO2 emission calculating unit for the present time calculates, or the electricity consumption of the air conditioner during a period starting from switching the power ON at the present time and ending at power OFF that the stored energy usage per unit time storing unit for the present time stores, is displayed on the displaying unit.

5. The air conditioner according to claim 4, wherein the setting apparatus can instruct the control apparatus to display on the displaying apparatus any of the predicted information (1) or (2) or (3) or (4) among the following predicted information displayed on the displaying apparatus at a stop of the operation (1) the electricity charge incurred during a period starting from switching the power ON at the present time and ending at power OFF that the electricity charge calculating unit for the present time calculates;

(2) the amount of CO2 emission released during a period starting from switching the power ON at the present time and ending at power OFF that the amount of $CO_2$ calculating unit for the present time calculates;

(3) the electricity consumption of the air conditioner, during a period starting from switching the power ON at the present time and ending at power OFF that the stored energy usage per unit time storing unit for the present time stores; or (4) does not display any one of (1), (2) and (3).

* * * * *